United States Patent [19]

Fletcher et al.

[11] Patent Number: 4,548,791

[45] Date of Patent: Oct. 22, 1985

[54] THALLIUM-CONTAINING COMPOSITION FOR STRIPPING PALLADIUM

[75] Inventors: Augustus Fletcher, Bristol; William L. Moriarty, South Meriden, both of Conn.

[73] Assignee: American Chemical & Refining Company, Inc., Waterbury, Conn.

[21] Appl. No.: 537,945

[22] Filed: Sep. 30, 1983

[51] Int. Cl.[4] ..... C23F 3/04

[52] U.S. Cl. ..... 423/22; 423/29; 75/105

[58] Field of Search ..... 423/22, 23, 27, 29; 75/105, 107, 118 R, 97 R; 156/664

[56] References Cited

U.S. PATENT DOCUMENTS

| | | | |
|---|---|---|---|
| 2,185,858 | 1/1940 | Mason | 75/105 |
| 2,649,361 | 8/1953 | Springer et al. | 75/97 R |
| 3,242,090 | 3/1966 | Grunwald | 75/105 |
| 3,437,431 | 4/1969 | Platz et al. | 75/121 |
| 3,655,363 | 4/1972 | Tsutsumi | 75/101 R |
| 3,676,219 | 7/1972 | Schroeder et al. | 252/79.2 |
| 3,787,239 | 1/1974 | Schroeder et al. | 252/79.2 |
| 3,819,494 | 6/1974 | Fountain | 75/105 |
| 3,839,110 | 10/1974 | Shankoff | 252/79.2 |
| 3,935,051 | 1/1976 | Solidum et al. | 75/105 |

FOREIGN PATENT DOCUMENTS

| | | | |
|---|---|---|---|
| 0285833 | 1/1967 | Australia | 75/105 |

*Primary Examiner*—L. Dewayne Rutledge
*Assistant Examiner*—S. Kastler

[57] ABSTRACT

A solution for simultaneously stripping gold and palladium-containing deposits from substrates carrying them is provided, which is capable of efficient operation under practical and desirable conditions, particularly for recovering the precious metal electroplate and flash coatings from electronic components. The solution contains a thallium compound, in addition to a nitrobenzoate derivative, a soluble cyanide, and certain optional ingredients.

15 Claims, No Drawings

THALLIUM-CONTAINING COMPOSITION FOR STRIPPING PALLADIUM

BACKGROUND OF THE INVENTION

Electrodeposits of gold are commonly provided on electronic devices to afford excellent wear and corrosion protection, outstanding electrical properties, and other advantageous characteristics. There has developed, however, a trend toward the substitution of palladium and/or palladium/nickel alloys for the gold plate used in the past, and such palladium deposits may most beneficially carry a gold flash overlayer to enhance the wear and corrosion properties. Due to the cost of the precious metals employed, it has become extremely important that means be provided for stripping them from the substrate completely and with minimum contamination, both to remove imperfectly formed deposits and also to permit recovery of the metal values from discarded or worn-out parts.

The prior art discloses means for effecting the removal of gold and/or palladium from substrates. For example, in U.S. Pat. No. 2,185,858 Mason teaches an electrolytic process for dissolving and precipitating gold, which is said to also be applicable for the recovery of palladium. In U.S. Pat. No. 3,819,494, Fountain teaches a method for stripping gold alloy brazing compositions which may contain palladium; the deposit is first subjected to treatment with a composition containing an alkali cyanide and a nitro-substituted aromatic compound, followed by treatment with a nitric acid solution, optionally containing hydrochloric acid. A highly effective formulation for stripping gold and silver is disclosed in Solidum U.S. Pat. No. 3,935,005; the baths are, however, quite ineffective for palladium.

Thus, despite the foregoing prior art disclosures, the need remains for a composition which is capable of simultaneously stripping deposits comprised of palladium and gold in a single step, such as for the removal of gold flash-coated palladium layers from electronic components, and similar parts. It is of course important that any such stripper be capable of operation under practical conditions and at high rates of speed, that it not subject the typical substrate metals to substantial attack, that the make-up composition exhibit a relatively long shelf-life, and that the bath have a capacity for the dissolved metal which is sufficient to avoid the need for frequent replenishment and replacement. Furthermore, it is important that any such formulation be relatively inexpensive, and convenient to package and handle.

Accordingly, it is a fundamental object of the present invention to provide a novel composition which is effective to chemically strip palladium and palladium/nickel alloy deposits from substrates at high rates, without need for electrical energy, and under desirable and practical operating conditions.

An equally important object of the invention is to provide such a formulation which is effective to chemically strip gold simulataneously with such palladium deposits.

Additional objects of the invention are to provide such a novel and relatively economical composition which does not subject the plated substrate metal to undue attack, which has a good capacity for the dissolved metals, which can readily and effectively be rejuvenated to extend its useful life, which can be made up with minimum risk to the operator, and which is conveniently packaged and exhibits a relatively long shelf-life Further objects of the invention are to provide novel solutions comprised of such formulations, and to provide novel methods by which the solutions are employed in stripping operations, and particularly to strip deposits comprised of palladium and gold, in a single step.

SUMMARY OF THE INVENTION

It has now been found that certain of the foregoing and related objects of the invention are readily attained by the provision of a water-soluble composition comprised, on a weight basis, of about 8 to 30 parts of a nitrobenzoic acid derivative selected from the group consisting of chloronitrobenzoic acids, alkali metal nitrobenzoates, and mixtures thereof; about 40 to 135 parts of a cyanide radical source compound; about 0.03 to 0.1 part of a thallium compound; and optionally about 0.08 to 0.3 part of a lead compound. Normally, the lead compound will only be included when thallium is present in its plus-one oxidation state; the preferred nitrobenzoic acid derivatives are sodium meta nitrobenzoate and 2-chloro-4-nitrobenzoic acid, thallium will preferably be furnished as the thallium nitrate salt, and the preferred source of lead will be the acetate compound.

Other objects of the invention are attained by the provision of an aqueous stripping solution comprised of water, in addition to the ingredients hereinbefore specified. Generally, the composition will be dissolved in an amount sufficient to provide about 0.025 to 0.075 gram of thallium ion per liter of the resultant aqueous solution.

Still other objects are attained in a metal deposit stripping method, using an aqueous solution of the foregoing composition, at a temperature of about 18° to 55° Centrigrade. The workpiece, plated with palladium or palladium/nickel alloy, and advantageously having a very thin layer of gold thereupon, is immersed in the bath for a period of time sufficient to substantially remove the deposit therefrom, following which it is withdrawn and rinsed to remove any residual solution. Preferably, the method will be effected with the bath at a temperature of about 25° to 35° Centigrade.

DETAILED DESCRIPTION OF THE PREFERRED EMBODIMENTS

As has been indicated hereinabove, the composition of the present invention essentially includes a nitrobenzoic acid derivative, a cyanide compound, and a thallium salt; optionally, it may also include a lead salt, and an hydroxide compound. Each of these several ingredients will be discussed in greater detail hereinbelow, as will be typical operating conditions for the stripping method, and other factors.

Although other water-soluble nitrobenzoic acid derivatives may be utilized, the alkali metal nitrobenzoates and the chloronitrobenzoic acids, particularly sodium meta nitrobenzoate and 2-chloro-4-nitrobenzoic acid, will preferably be used; mixtures of two or more such nitrobenzoic acid derivatives may also be employed. Generally, this component will be included in the stripping solution in a concentration of about 8 to 30 grams per liter, and about 18 grams per liter will often be found to be most desirable.

About 40 to 135 grams per liter of the cyanide compound will normally be used, and most desirably its solution concentration will be on the order of about 90 grams per liter. Although other soluble alkali metal and ammonium cyanide compounds may of course be substituted, potassium cyanide will often be the most desirable cyanide source.

The thallium ion may be furnished as either the plus-one (i.e., the thallous) or plus-three (i.e., the thallic) compound, but in either case about 0.03 to 0.1 gram per liter thereof will be effective. While the nitrate salts will often be found to be the most suitable for use, other soluble thallium compounds, such as the sulfates, phosphates, etc., may be substituted if so desired.

It has surprisingly been found that the desirability of including lead in the solution will depend to a large extent upon the oxidation state of the thallium ion. It is highly advantageous when, for example, thallous nitrate is used, but will generaly be excluded when thallic nitrate constitutes the thallium source. When lead is included, the compound that furnishes will normally be added in an amount of about 0.08 to 0.3 gram per liter, and in the preferred case its concentration will be about 0.2 gram. Generally, the source of the lead ion will be the acetate compound, but once again other suitable alternatives will occur to those skilled in the art.

The preferred pH range for the bath is 11 to 13; although it will often be desirable to include a basic compound to establish or adjust that value, in many instances the other ingredients of the stripping solution will inherently provide the desired pH. When utilized, the concentration of the base (e.g., potassium hydroxide) will generally be about 4.0 to 15, and most desirably about 9, grams per liter of solution.

Whether in the form of a dry powder or of a liquid, the stripping compositon must of course be readily soluble in water, in concentrations sufficient to produce an effective solution. The amount of the composition used may vary, to furnish from as little as 0.025 gram per liter of thalium ion to as much as 0.075 gram per liter or more (amounts of the other ingredients being in the proportions mentioned above); higher concentrations will generally be found to afford little if any significant benefit, and may indeed be inefficient, particularly from the economic standpoint. As the stripping rate decreases during the course of operation, the bath can be replenished by additions of the composition, typically in amounts equivalent to about a one-quarter strength bath. After two, or perhaps three, such additions have been made, the capacity of the bath will generally have been reached, as a practical matter. At that time, the dissolved precious metal values may be recovered from the solution, and this may generally be done either electrolytically or by chemical means. For example, destruction of the cyanide complex, by any conventional technique, may be relied upon to cause precipitation of insoluble compounds containing the metal(s).

The stripping solution may most advantageously be used at ambient to low elevated temperatures, on the order of about 18° to 55° Centigrade, temperatures of 25° to 35° generally being preferred. Maintaining the bath above about 55° Centigrade will materially reduce its life, and should generally be avoided except in instances in which the stripping rate is to be maximized.

Contact with the workpiece surface may be effected by any convenient means. Due to the tendency for oxidation of the cyanide to occur when the solution is applied by spraying, however, immersion techniques will generally be considered more advantageous. The time of contact will of course vary, depending upon temperature, the strength of the bath, and the thickness of the deposit to be removed. Because of the corrosive nature of li the bath, the apparatus used in the stripping operations will desirably employ a surface of stainless steel, polypropylene, or a similar inert synthetic resinous material, which may desirably be reinforced with fiberglass or the like.

In practice, it has been found that gold, palladium, and palladium/nickel alloys (normally containing at least 80 weight percent of palladium) can readily be stripped from substrates of stainless steel, nickel, copper, Kovar, etc., utilizing the composition and solutions of the invention. Stripping will proceed at a rate of at least 0.8 micrometer per minute; generally, the rate will be at least 1.0 micrometer per minute,and preferably it will be 2.0 micrometers per minute or higher. Although an inherent advantage that they exhibit concerns their low dissolution rate of copper and nickel substrates, still it may be desirable to control the period of immersion of the workpiece in the bath, so as to minimize any attack, particularly under high temperature operating conditions.

Exemplary of the efficacy of the present invention are the following specific examples:

EXAMPLE ONE

An aqueous solution was prepared by dissolving in water 17.6 grams per liter of sodium meta nitrobenzoate, 88 grams per liter of potassium cyanide, 8.8 grams per liter of potassium hydroxide, and 0.176 gram per liter of lead acetate. A palladium-plated nickel coupon was immersed therein at a bath temperature of 21° Centigrade. A palladium dissolution rate of about 0.015 micrometer per minute was achieved. The bath was heated to a temperature of about 38° Centigrade, and the test was repeated with a fresh coupon; the stripping rate was about 0.2 micrometer per minute. At 54° Centigrade, the rate of palladium removal was approximately 0.29 micrometer per minute.

EXAMPLE TWO

Part A

A fresh solution was prepared and tested as described in Example One, except that the solution was modified by the inclusion of about 0.066 gram per liter of thallous nitrate. Palladium stripping rates (in micrometers per minute) of about 1.45 at 21° Centigrade, about 2.44 at 38° Centrigrade, and about 2.64 at 54° Centrigrade were achieved.

Part B

Decreasing the thallium concentration of the Part A bath to 0.033 gram per liter produced stripping rates of about 1.17, 1.63 and 1.78 micrometers per minute, respectively, at the three temperatures.

Part C

Increasing the thallium concentration of the Part A bath to 0.99 gram per liter resulted in respective rates of about 1.35, 3.05 and 3.30 micrometers of palladium removal per minute. It is to be noted that, with the bath at room temperature, the maximum stripping rates were realized using 0.066 gram per liter of the thallium compound.

Part D

Repetition of the same tests with the Part A solutions at approximately half- and double-strength generally produced stripping rates that were commensurately lower and higher, respectively.

Part E

Again using the proportions of ingredients described in Example One, but including in the bath 0.132 gram per liter of the thallous nitrate, to provide an indication of maximum palladium capacity, the half-strength solution (comparable to Part B hereof) dissolved about 12 grams per liter of the metal, the preferred bath (comparable to Part A hereof) dissolved about 19 grams per liter thereof, and the double-strength bath (comparable to Part C) was capable of dissolving about 28 grams per liter.

Part F

The thallium nitrate, added to the solution of Example One to produce the bath of Part A hereof, was replaced with each of the metals: arsenic, tellurium, antimony, aluminum, sodium/bismuth, and indium, and the stripping rates of palladium from the coupon were determined as described. The results (at 38° Centrigrade and expressed in micrometers per minute) were 0.05, 0.2, 0.05, zero, 0.2, and zero, respectively.

Part G

The bath of Part A was formulated without potassium hydroxide, and tested at 21° Centrigrade; the pH of the solution was about 12.8. The initial stripping rate was about 3.05 micrometers of palladium removed per minute, in the fresh bath; the rate diminished steadily with time, ultimately to a value of about 0.86 micrometers per minute after approximately 82 minutes of operation. The palladium capacity of the bath was determined to be about 13.3 grams per liter.

From the two preceding Examples, the beneficial effects of the inclusion of thallium in a bath of the sort described, are clearly demonstrated.

EXAMPLE THREE

A half-strength bath, produced as described in Part B of the previous Example, was tested to determine the effects of depletion and rejuvenation. Operating at a temperature of 21° Centrigrade, the amount of palladium stripped after the first hour was found to be about 3.1 grams; during the next hour about 2.1 additional grams of the metal was removed, and during the succeeding half hour one more gram was dissolved. Replenishing the bath, by introducing the constituents at concentrations equal to 25 weight percent of the amounts initially used, permitted the dissolution of 2.6 additional grams of palladium during the first hour of resumed operation, and of a further 2.1 grams during the next hour. The total amount of palladium dissolved, throughout a 4.5-hour operation period, was 11 grams, and the average stripping rate was 0.805 micrometer per minute.

EXAMPLE FOUR

Part A

Eight stripping baths were produced by individually adding the following compounds to the solution of Example One, each in a concentration sufficient to contribute 50 parts per million of metal ion to the bath: (1) arsenic trioxide, (2) tellurium dioxide, (3) potassium antimony tartrate, (4) aluminum sulfate, (5) sodium bismuth tartrate, (6) indium nitrate, (7) thallous nitrate, and (8) thallic nitrate. Testing for stripping at 38° Centrigrade, as in the foregoing Examples, produced an initial strip rate of 2.18 micrometers per minute and 1.88 micrometers per minute for the thallous and thallic ion-containing solutions, (7) and (8) respectively; 0.05 micrometer per minute for the arsenic solution (1); and 0.02 micrometer per minute for the indium bath (6). There was virtually no effect upon the palladium deposit produced by any of the other solutions, i.e., nos. (2)–(5).

Part B

Stripping was continued in the above-described thallium baths; the thallous ion bath achieved a rate of 1.75 micrometers per minute during the first additional hour, and a rate of 0.81 micrometer per minute during the second hour; the thallic ion bath producing rates of 1.66 and 0.3 micrometers per minute during the same periods. Replenishment of the two solutions with one-quarter strength make-up compositions extended the operational life of each bath for periods in excess of an additional hour, and both of the solutions (as replenished) were capable of dissolving a total of at least 21 grams per liter of the metal.

Part C

Fresh formulations, produced in accordance with Part A hereof, were tested to determine their ability to dissolve gold, under the described conditions. The thallous ion solution stripped gold at a rate of 0.8 micrometer per minute, and the thallic ion bath functioned at a rate of about 1.0 micrometer per minute.

Part D

The addition of 0.176 gram per liter of lead acetate to the thallic ion solution formulated in accordance with Part A hereof was tested for its ability to strip palladium at temperatures 21°, 38°, Centrigrade, and 54° Centrigrade. In each instance the solution was found to be ineffective, as a practical matter, thus demonstrating a surprising effect of the oxidation state of the thallium upon the character of the bath.

EXAMPLE FIVE

Part A

The solution described in Part A of Example Two was prepared, substituting however for the sodium meta nitrobenzoate utilized therein an equal amount of 2-chloro-4-nitrobenzoic acid. The resultant solution was evaluated at 21°, 38°, and 54° Centrigrade for its ability to strip palladium, in the manner described therein. Stripping rates of 2.66, 2.70 and 3.8 micrometers per minute were achieved, respectively.

Part B

Carrying out the same series of tests utilizing a half-strength solution produced stripping rates of 1.73, 1.88, and 2.1 micrometers per minute at the three temperatures.

Part C

Repeating the foregoing tests with double-strength solutions achieved rates of 3.93, 4.86 and 7.1 micrometers per minute, again at 21°, 38°, and 54° Centrigrade, respectively.

Part D

The bath of Part A of this Example was prepared, except for the omission of the lead acetate ingredient, and was tested for its ability to strip palladium at 38° Centrigrade. A rate of about 1.43 micrometers per minute was achieved, and the solution demonstrated a capacity of 24 grams per liter of the metal.

Part E

The solution described in Part D hereof was prepared, substituting an equal weight of thallic nitrate for the thallous nitrate utilized therein, and again omitting the lead compound from the formulation. Testing at 38°

Centrigrade achieved a stripping rate of 2.78 micrometers per minute, and the bath evidenced a palladium solution capacity of 24 grams per liter.

The solution of each of the several Parts of this Example is found to strip gold at a rate of approximately 1.5 micrometers per minute, at room temperature.

EXAMPLE SIX

Example Two, Part A, is again repeated, utilizing as the workpiece a copper coupon electroplated with a palladium/nickel (80:20) alloy. Results comparable to those reported in the earlier Example are achieved, and no substantial attack upon the copper substrate is evidenced.

EXAMPLE SEVEN

Two baths are made up, each containing 88.0 grams per liter of potassium cyanide, 8.8 grams per liter of potassium hydroxide, and 0.032 gram per liter of thallous acetate; one of the two solutions additionally contained 17.6 grams per liter of sodium meta nitrobenzoate, and the other contained the same quantity of 2-chloro-4-nitrobenzoic acid. The baths were tested at room temperature by immersing a palladium-plated coupon therein, and each evidenced a stripping rate of 1.625 micrometers per minute. Additions of lead acetate (0.088 gram per liter) were found to have little effect upon performance. The sodium meta nitrobenzoate bath demonstrated a capacity to dissolve about 31 grams per liter of palladium, whereas the chloronitrobenzoic acid solution had a total capacity of about 28.2 grams per liter.

Thus, it can be seen that the present invention provides a novel composition, which is effective to strip palladium, palladium/nickel alloy, and gold deposits from substrates at high rates (i.e., of at least about 0.8, and preferably at about 1.0, micrometer per minute) and under desirable and practical operating conditions, thus rendering it especially suitable for recovering precious metal values from electronic components, and the like. Solutions of the composition do not subject typical substrate metals to undue attack, they can be formulated with minimum risk to the operator, and they have a good capacity for the dissolved metals. The compositions are relatively economical, conveniently packaged, and exhibit relatively long shelf-life. The invention also provides novel solutions of such compositions, and novel methods for using the solutions in stripping operations.

Having thus described the invention, what is claimed is:

1. A composition for addition to water to produce a solution for stripping gold, palladium, and palladium/nickel alloy deposits from substrates, comprised of: (1) about 8 to 30 parts of a nitrobenzoic acid derivative selected from the group consisting of chloronitrobenzoic acids, alkali metal nitrobenzoates, and mixtures thereof; (2) about 40 to 135 parts of a cyanide radical source compound; (3) about 0.03 to 0.1 part of a thallium compound; and (4) optionally about 0.08 to 0.3 part of a lead compound, the foregoing ingredients of said composition being soluble in water, and said parts thereof being expressed on a weight basis.

2. A composition for addition to water to produce a solution for stripping gold, palladium, and palladium/nickel alloy deposits from substrates, consisting essentially of: (1) about 8 to 30 parts of a nitrobenzoic acid derivative selected from the group consisting of chloronitrobenzoic acids, alkali metal nitrobenzoates, and mixtures thereof; (2) about 40 to 135 parts of a cyanide radical source compound; (3) about 0.03 to 0.1 part of a thallous compound; (4) about 0.08 to 0.3 part of a lead compound; and (5) optionally, an effective amount of a base compound for pH control, the foregoing ingredients of said composition being soluble in water, and said parts thereof being expressed on a weight basis.

3. A composition for addition to water to produce a solution for stripping gold, palladium, and palladium/nickel alloy deposits from substrates, consisting essentially of: (1) about 8 to 30 parts of a nitrobenzoic acid derivative selected from the group consisting of chloronitrobenzoic acids, alkali metal nitrobenzoates, and mixtures thereof; (2) about 40 to 135 parts of a cyanide radical source compound; (3) about 0.03 to 0.1 part of a thallic compound; and (4) optionally an effective amount of a base compound for pH control, the foregoing ingredients of said composition being soluble in water, and said parts thereof being expressed on a weight basis.

4. The composition of claim 1, 2 or 3 wherein said nitrobenzoic acid derivative is sodium meta nitrobenzoate.

5. The composition of claim 1, 2 or 3 wherein said nitrobenzoic acid derivative is 2-chloro-4-nitrobenzoic acid.

6. The composition of claim 1, 2 or 3 wherein said thallium compound is the nitrate.

7. The composition of claim 2 wherein said lead compound is lead acetate.

8. A composition for addition to water to produce a solution for stripping gold, palladium, and palladium/nickel alloy deposits from substrates, consisting essentially of about 8 to 30 parts of sodium meta nitrobenzoate, about 40 to 135 parts of potassium cyanide, about 0.03 to 0.1 part of thallous nitrate; about 0.08 to 0.3 part of lead acetate; and optionally about 4 to 15 parts of potassium hydroxide, said parts being expressed on a weight basis.

9. A composition for addition to water to produce a solution for stripping gold, palladium, and palladium/nickel alloy deposits from substrates, consisting essentially of about 8 to 30 parts of 2-chloro-4-nitrobenzoic acid, about 40 to 135 parts of potassium cyanide, about 0.03 to 0.1 part of thallium nitrate, about 0.08 to 0.3 part of lead acetate when said nitrate is thallous nitrate, and optionally, about 4 to 15 parts of potassium hydroxide, said parts being expressed on a weight basis.

10. An aqueous solution for stripping gold, palladium, and palladium/nickel alloy from substrates, comprised of water; about 8 to 30 parts of a nitrobenzoic acid derivative selected from the group consisting of chloronitrobenzoic acids, alkali metal nitrobenzoates, and mixtures thereof; about 40 to 135 parts of a cyanide radical source compound; about 0.03 to 0.1 part of a thallium compound; optionally about 0.08 to 0.3 part of a lead salt; and, as needed, an amount of a basic compound sufficient to maintain a pH value of about 11 to 13 in said solution, the foregoing ingredients of said composition being soluble in water and said parts thereof being expressed on a weight basis, said thallium salt being included in a concentration sufficient to provide about 0.025 to 0.075 gram of thallium ion per liter of said solution.

11. In a method for stripping gold, and/or palladium or palladium/nickel deposits from substrates, the steps comprising:

a. dissolving in water a composition comprised of (1) about 8 to 30 parts of a nitrobenzoic acid derivative selected from the group consisting of chloronitrobenzoic acids, alkali metal nitrobenzoates, and mixtures thereof, (2) about 40 to 135 parts of a cyanide radical source compound, (3) about 0.03 to 0.1 part of a thallium compound, (4) optionally, about 0.08 to 0.3 part of a lead compound, and (5) as needed, an amount of an hydroxide compound sufficient to maintain a pH value of about 11 to 13 in the resultant solution, the foregoing ingredients of said composition being soluble in water, and said parts thereof being expressed on a weight basis;

b. maintaining said solution at a temperature of about 18° to 55° Centigrade;

c. immersing in said solution a workpiece having a deposit thereon of a metal selected from the group consisting of gold and/or palladium and palladium/nickel alloys, and maintaining said workpiece therein for a period of time sufficient to substantially remove the deposit; and d. rinsing said workpiece to remove any residue of said solution therefrom.

12. The method of claim 11 wherein said solution is maintained at a temperature of about 25° to 35° Centigrade.

13. The method of claim 11 wherein said composition is dissolved in water in an amount sufficient to provide about 0.025 to 0.075 gram of thallium ion per liter of said solution.

14. The method of claim 11 wherein said workpiece deposit comprises a palladium base layer with a gold flash layer thereupon.

15. The method of claim 11 wherein said deposit is removed at a rate of at least about 1.0 micrometer per minute.

* * * * *